United States Patent [19]

Ackmann

[11] Patent Number: 4,856,688

[45] Date of Patent: Aug. 15, 1989

[54] HANGER CARRYING/HOLDING DEVICE

[76] Inventor: Martin E. Ackmann, 851 Bode Rd., Elgin, Ill. 60120

[21] Appl. No.: 14,447

[22] Filed: Feb. 13, 1987

[51] Int. Cl.[4] ..... A47G 25/06

[52] U.S. Cl. ..... 224/217; 224/218; 224/251; 224/313; 294/142

[58] Field of Search ..... 224/217, 313, 197, 218, 224/249, 251; 59/78, 85, 88; 70/457; 72/192; 128/359; D24/45; 294/142, 145, 137, 25

[56] References Cited

U.S. PATENT DOCUMENTS

| | | | |
|---|---|---|---|
| 862,197 | 8/1907 | Pryor, Jr. | 70/456 R |
| 1,286,610 | 12/1918 | Harriman | 224/217 |
| 2,292,563 | 8/1942 | Imhoff | 224/217 X |
| 2,830,478 | 4/1958 | Prince | 224/197 X |
| 3,578,226 | 5/1971 | Good | 294/137 |
| 3,584,772 | 6/1971 | Robertson | 224/313 X |
| 4,355,804 | 10/1982 | Bingham | 224/251 X |
| 4,466,652 | 8/1984 | Townsend | 294/142 |

FOREIGN PATENT DOCUMENTS

| | | | |
|---|---|---|---|
| 409134 | 4/1910 | France | 59/85 |

*Primary Examiner*—Renee S. Luebke

*Attorney, Agent, or Firm*—Charles F. Lind

[57] ABSTRACT

The disclosed device consists of a unitary structural piece formed as two loops, meeting edge-to-edge like a figure eight, except the loops are rotated to be normal to one another; and aligned diametrically. The loops may be circular in shape, and may be between approximately one and four inches in internal diameter. One embodiment has the loops molded of a high strength plastic, such as polyethylene; while another has the loops cast of a lightweight metal, such as an aluminum alloy, coated then with a non-marring overwrap, such as a plastic or rubber. The loops are formed of circular cross-sections, between possibly 0.2–0.5 of an inch in diameter. Hangers can be hooked onto either loop; and the other loop can be fitted over a structural hook, such as in an automobile, or can be fitted over someone's finger(s), in carrying the device.

8 Claims, 1 Drawing Sheet

HANGER CARRYING/HOLDING DEVICE

FIELD OF THE INVENTION

This invention relates to a device for carrying and/or holding one or more hangers, on which garments or the like are hung.

BACKGROUND OF THE INVENTION

Clothes hangers, for holding garments or the like, come in many shapes and sizes...but each typically has some form of lower cross member, adapted to cooperate with the item to be held; and an upper curved hook portion, adapted to be supported over a bar in a closet, garment or display rack, or the like. Metal hook portions, for conventional wire hangers and for more expensive suit hangers having wood or plastic cross members, typically are formed of relatively small cross-section wires, between 0.05–0.15 of an inch in diameter. Plastic hangers have larger plastic hook portions, typically between 0.15–0.35 of an inch diameter in cross-section. As the hook portion need not be made of cylindrical shape, but can be of a rectangular or any irregular shape, such sizes are given only for reference.

The upper hook portion may typically be curved over about a half circle, being downwardly, with one end blending into a vertically oriented stem extended downwardly to the cross member; and, at the other end terminating at a free point spaced from the stem. The hook portion ends may be spaced apart by perhaps between 1½ and 2 inches, to fit over most support bars in closets, clothing or display racks, or the like.

Depending on the shape of the stem portion, immediately below the hook portion, the hook portion may be curved over perhaps 165°–200°.

To carry one of such hangers, one grips the hook portion, typically with the index and middle fingers, as the curve of the hook portion is too small to grip otherwise. However, the thin hook portion, depending on the weight carried, can create significant pressure against the fingers, to cause discomfort and/or even cut into the fingers. Moreover, the free pointed end of the hook portion is there to dig into the skin, causing added discomfort and/or injury.

When several such hangers are carried at one time, the above-mentioned problems quickly mount. Particular notice of this can be taken in carrying a relatively large load of dry cleaning, consisting of possibly four or more thin wire hangers.

Garment bags of the type having hook portions, like a hanger, only somewhat larger, also are of interest to this invention. Even though the garment bar hanger has a hook portion curved over a much larger curvature, to fit across the palm of the hand, it still is formed of generally small wire, less than 0.2 inch in diameter. Some difficulty may still exist in carrying such a garment bag, as one frequently loads too much weight in the bag, to have the cutting pressure of the curved hook portion increase correspondingly. Also, it is not uncommon to carry separate garments in the bag, each on its own hanger of conventional style; thus having many hook portions project from the garment bag, next to the garment bag hook portion. However, as the conventional hanger hook portions are shaped differently from the garment hook portion, such hook portions line up differently. The same cutting or poking problems of the many hangers can occur, as discussed above.

Yet again, automobile passenger compartments frequently have an upwardly extended finger or hook typically lined up near the center of the rear side window, onto which the hook portion of a hanger, garment bag, or the like can be hung. As the size and spacing of the hook is small . . . generally less than 0.5 inch in length and in spacing laterally from the frame . . . only a few metal hangers, and perhaps only a single plastic hanger can be hung on the hook at one time.

SUMMARY OF THE INVENTION

The present invention provides a device that may be used to carry or hold hook portions of conventional hangers, garment bags or the like.

The device has a unitary structural rigid piece, formed as two loops meeting edge-to-edge somewhat as a figure eight, except the loops are rotated relative to one another. In use, one or more hangers can be carried, the hook portion(s) of the hanger(s) being hooked onto either loop, and the other loop being fitted over and carried on someone's finger(s), or over a hook, such as in an automobile.

The loops may be normal to one another. Each loop may be circular in shape; and approximately between one and four inches in diameter.

The device may be molded of a high strength plastic, such as polyethelyne; or cast of a high strength lightweight metal, such as an aluminum alloy, and then coated with a non-marring overwrap, such as plastic.

Each loop may be formed of a circular cross-section, possibly between 0.2–0.4 of an inch in diameter, and preferably of the order of 0.3 of an inch in diameter.

One loop is slightly smaller than the other loop. The one loop may be between 1 inch and 2 inches in internal diameter, preferably 1¼ inhes; and the other loop may be between 2 and 4 inches in internal diameter; preferably 2 inches.

DETAILED DESCRIPTION OF ILLUSTRATED EMBODIMENTS

The disclosed hanger carrying/holding device 8 consists of a unitary rigid structural piece 10 formed as two loops 12 and 14 meeting edge-to-edge at 16, somewhat as a figure eight; except the loops are rotated or angled relative to one another. As is illustrated in FIGS. 2 and 4. the rotational alignment of the loops may be normal to one another.

Figure 1:
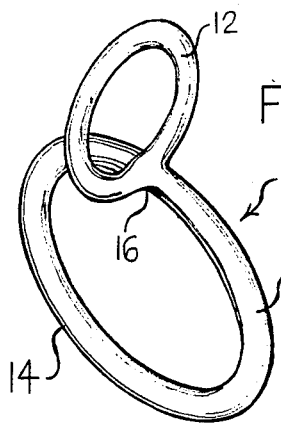
FIG. 1 is a perspective view of a first embodiment of the hanger carrying/holding device, to be disclosed herein.
Figure 2:
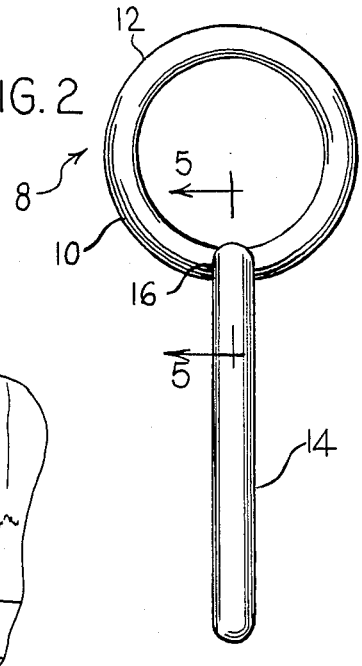
FIG. 2 is a frontal elevational view of the device of FIG. 1.
Figure 4:
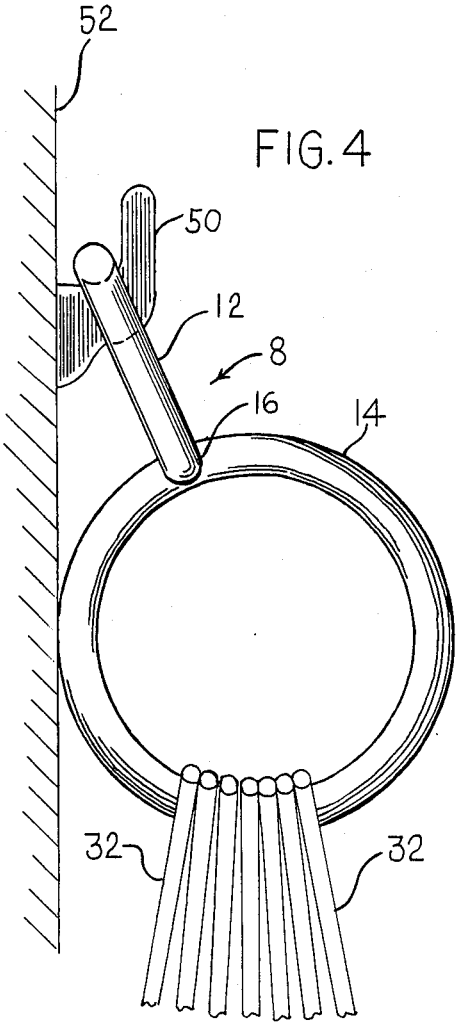
FIG. 4 is a side elevational view of the hanger carrying/holding device, illustrated in a second mode of use, being hung on a hook, as might be typical in an automobile passenger compartment.

Each loop 12 and 14 may have a circular shape (see FIGS. 2 and 4). Loop 12 is illustrated as smaller than loop 14.

Loop 12 may be between 1 inch and 2 inches in internal diameter; preferably 1¼ inhes. Loop 14 may be between 2 and 4 inches in internal diameter; preferably 2 inches.

Figure 5:
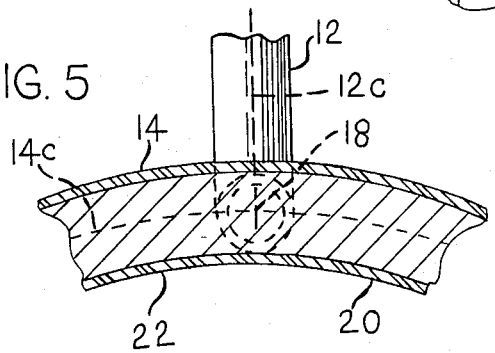
FIG. 5 is a sectional view, as seen from line 5—5 in FIG. 2.

Each loop 12 and 14 is formed of a generally circular cross-section (see FIG. 5). The loops 12 and 14 meet at 16, with the centers 12C and 14C of both circular cross sections crossing at a point 18.

The loops 12 and 14 are also aligned diametrically; or the planes defined by the loops are normal to one another. Again, this is illustrated in FIGS. 2 and 4.

One embodiment of the device illustrated in FIGS. 1–5 has loop 12 formed of slightly smaller cross-section than the loop 14. The cross-section of loop 12 may be between 0.2–0.4 inch; preferably 0.25 inch. The cross-section of loop 14 may be between 0.25–0.4 of an inch; preferably 0.30 of an inch.

Figure 6:
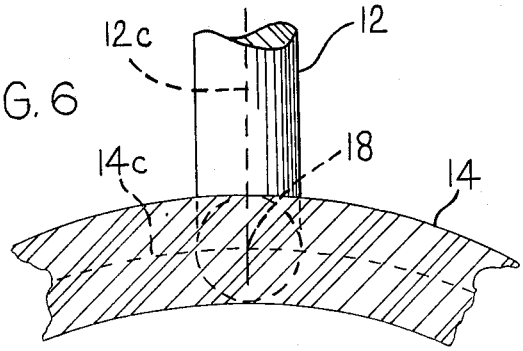
FIG. 6 is a sectional view, similar to FIG. 5 except illustrating a second embodiment of the hanger carrying/holding device.

The other embodiment of the device illustrated in FIG. 6 has the loops 12 and 14 formed of the same circular cross-section; which may be between 0.2–0.5 of an inch, but preferably 0.30 of an inch. Again, the centers 12C and 14C of both circular cross sections crossing at a point 18.

One embodiment of the device 8 illustrated in FIGS. 1–5 has the unitary piece 10 formed of a body 20 of metal; with a non-marring overwrap 22 of a plastic or rubber. A preferred metal will be a lightweight strong metal, such as an aluminum alloy, that can be cast to form the metal body 20 in a single step. The overwrap 22 can then be formed over the body 20, as by dipping in liquid material of the overwrap.

The other embodiment of the device illustrated in FIG. 6 has the unitary piece 10 formed of plastic; and does not need or have a non-marring overwrap (like 22 illustrated in FIG. 5. A preferred plastic will be strong and rigid, such as high strength polyethelyne, which can be molded to form the unitary piece in a single step.

OPERATION OF THE DEVICE

Figure 3:
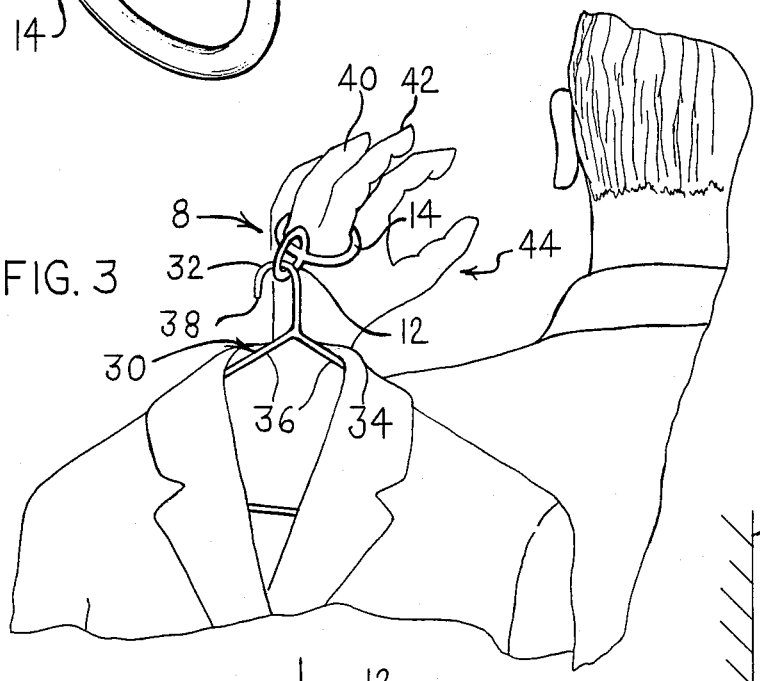
FIG. 3 is a perspective view of the hanger carrying-/holding device, illustrated in a first mode of use, being carried on someone's fingers.

FIG. 3 illustrated a hanger 30, having an upper hook portion 32 that may typically be curved over about a half circle, being open downwardly, with one end blending into a vertically oriented stem 34 extended to the cross member 36; and, at the other end 38 terminating at a free point spaced from the stem 34. The hook portion ends may be spaced apart by perhaps between 1½ and 2 inches, to fit over most support bars.

Depending on the shape of the stem 34, immediately below the hook portion, the hook portion 32 may be curved over perhaps 165°–200°.

One or more of such hangers 30 can be hooked onto either loop 12 or 14, with the free end 38 of the hanger hook portion 32 being fitted through the loop. This is illustrated with but a single hanger 30 being hung onto the smaller loop 12 in FIG. 3; while a plurality of hook portions 32 of many hangers are shown hung onto the larger loop 14, in FIG. 4.

In FIG. 3, the larger loop 14 is illustrated as being fitted over the ring and middle fingers 40 and 42 on someone's hand 44, for carrying the device 8. In FIG. 4, the smaller loop 12 is illustrated as being hung over a hook 50, such as is common in an automobile, secured to the frame 52.

One advantage of having the loops 12 and 14 circular in shape is that the loop automatically centers itself on the fingers 40 and 42, or on the hook 50; while the hanger hook portions 32 automatically center themselves at the lower portions of the loop. As is illustrated in FIG. 4, the hook portions 32 may lie adjacent one another, or may overlap one another (not shown).

One advantage of having one hook 12 smaller than the other loop 14 is the reduced size of the device. However, as either loop 12 or 14 of the device may be used for the hangers 30, the other loop then may be used to hook onto a structural hook or one's finger(s).

Even the smaller loop is greatly larger than the normal space defined between the automobile hook 50 and the frame 52, to hold many more hangers on the hook 50 than without the device.

While specific embodiments have been disclosed herein to illustrate the invention, it will be apparent that modifications may be made therefrom without departing from the inventive concept. Accordingly, it is intended that the invention be limited only by the scope of the following claims.

What I claim as my invention is:

1. A device to hold/carry hangers each having a downwardly open hook portion, the device comprising:

a unitary structurally nondeformable rigid piece formed as two generally planar loops, meeting edge-to-edge like a figure eight, except with the loops being rotated to be normal to one another;

each loop being formed unitary, endless and in the shape of a circle continuously throughout its full 360 degrees and having no moving parts;

each loop moreover being formed of a circular cross-section, and the centers of said cross-sections crossing where the loops meet, and the loops being diametrically aligned on opposite sides of where the loops meet; the cross-section of each loop being between 0.2–0.5 of an inch;

the device thereby being substantially symmetrical in the direction through the loops, except for one loop being slightly smaller than the other loop: said one smaller loop being between 1 and ¼ inch and 2 inches in internal diameter, and the other larger loop being between 2 and 4 inches in internal diameter; whereby the device allows the hook portions of said hangers to be hooked loosely onto either loop to be retained thereon solely by gravity, and the remaining loop to be fitted loosely over and carried on at least one and more commonly several of the user's fingers, or over a hook, such as in an automobile, and because of the device symmetry, the hanger(s) will be retained loosely on said either loop at a location approximately diametrically opposite where the remaining loop is carried on the user's finger(s) or the hook.

2. The device to hold/carry hangers, according to claim 1, further wherein said one smaller loop has an internal diameter of 1 & ¼ inches; and wherein the other larger loop has an internal diameter of 2 inches.

3. The device to hold/carry hangers, according to claim 1, further wherein said one smaller loop circular cross-section is approximately 0.25 of an inch and said other larger loop circular cross-section is approximately 0.3 of an inch.

4. The device to hold/carry hangers, according to claim 1, further wherein said device is formed of a high strength plastic, such as polyethelyne,

5. The device to hold/carry hangers, according to claim 1, further wherein said device is cast of a high strength lightweight metal, such as an aluminum alloy;

and further wherein said loops are coated with a non-marring overwrap, such as of plastic or rubber.

6. The device to hold/carry hangers, according to claim 1, further wherein said one smaller loop has an internal diameter of 1 & ¼ inches; and wherein the other larger loop has an internal diameter of 2 inches, and wherein said one smaller loop circular cross-section is approximately 0.25 of an inch and said other larger loop circular cross section is approximately 0.3 of an inch.

7. The device to hold/carry hangers, according to claim 6, further wherein said device is formed of a high strength nondeformable substantially rigid plastic, such as polyethelyne.

8. The device to hold/carry hangers, according to claim 6, further wherein said device is cast of a high strength lightweight nondeformable substantially rigid metal, such as an aluminum alloy; and further wherein said loops are coated with a thin non-marring overwrap, such as of plastic or rubber.

* * * * *